US011124002B2

(12) United States Patent
Percer et al.

(10) Patent No.: US 11,124,002 B2
(45) Date of Patent: Sep. 21, 2021

(54) PARTIAL PRINTING FLUID SHORT DETECTION

(71) Applicant: Hewlett-Packard Development Company, L.P., Spring, TX (US)

(72) Inventors: Ben Percer, San Diego, CA (US); James Hasler, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 21 days.

(21) Appl. No.: 16/615,727

(22) PCT Filed: Jun. 23, 2017

(86) PCT No.: PCT/US2017/039083
§ 371 (c)(1),
(2) Date: Nov. 21, 2019

(87) PCT Pub. No.: WO2018/236396
PCT Pub. Date: Dec. 27, 2018

(65) Prior Publication Data

US 2020/0171861 A1 Jun. 4, 2020

(51) Int. Cl.
*B41J 25/308* (2006.01)
*B41J 2/045* (2006.01)

(52) U.S. Cl.
CPC ..... *B41J 25/3082* (2013.01); *B41J 2/04573* (2013.01); *B41J 2/04586* (2013.01)

(58) Field of Classification Search
CPC .. B41J 25/3082; B41J 2/0451; B41J 2/04555; B41J 2/0457; B41J 2/04586; B41J 2/04573
USPC ..... 347/5, 8, 9, 19
See application file for complete search history.

(56) References Cited

U.S. PATENT DOCUMENTS

| | | | |
|---|---|---|---|
| 6,039,428 | A | 3/2000 | Juve |
| 6,378,979 | B1 | 4/2002 | Anderson |
| 7,165,824 | B2 | 1/2007 | Walmsley et al. |
| 7,168,779 | B2 | 1/2007 | Smith et al. |
| 7,571,973 | B2 | 8/2009 | Hasseler |
| 7,695,089 | B2 | 4/2010 | Espasa et al. |
| 8,777,364 | B2 | 7/2014 | Carrobe et al. |
| 2004/0183848 | A1 | 9/2004 | Hasseler |
| 2006/0139386 | A1 | 6/2006 | Silverbrook |
| 2011/0181677 | A1 | 7/2011 | Imaizumi |
| 2012/0025845 | A1 | 2/2012 | Carrobe |
| 2014/0267488 | A1 | 9/2014 | Ready |

FOREIGN PATENT DOCUMENTS

| | | |
|---|---|---|
| CN | 1935525 | 3/2007 |
| CN | 101697003 | 4/2010 |
| CN | 102189812 | 9/2011 |

(Continued)

OTHER PUBLICATIONS

HP DesignJet ColorPro CAD/HP DesignJet ColorPro GA Service Manual, 1999, Available online at: < http://www.lbrty.com/tech/Manuals_DN/DN_ColorProsm.pdf >.

*Primary Examiner* — An H Do
(74) *Attorney, Agent, or Firm* — Mannava & Kang

(57) ABSTRACT

A partial printing fluid short detection system can detect a partial printing fluid short in a print head. The partial printing fluid short detection system includes a timing circuit to detect a print gap of the print head, and the partial printing fluid short detection system can detect the partial printing fluid short in response to detection of the print gap.

12 Claims, 4 Drawing Sheets

(56) References Cited

FOREIGN PATENT DOCUMENTS

| | | |
|---|---|---|
| CN | 102873996 | 1/2013 |
| CN | 107073983 | 8/2017 |
| EP | 1462262 | 9/2004 |
| EP | 1917143 | 5/2008 |
| EP | 2425977 | 3/2012 |
| JP | 2000141730 B2 | 5/2000 |

PARTIAL PRINTING FLUID SHORT DETECTION

BACKGROUND

Printing mechanisms often include an inkjet print head which is capable of forming an image on many different types of media. The inkjet print head ejects droplets of colored printing fluid through a plurality of orifices and onto a given media as the media is advanced through a print zone. The print zone may include a plane created by the print head orifices and any scanning or reciprocating movement the print head may have back-and-forth and perpendicular to the media or may include movement of the media under a fixed print head with the nozzles that are perpendicular to the movement of the media. Methods for expelling printing fluid from the print head orifices, or nozzles, may include piezoelectric and thermal techniques.

In a thermal inkjet system, a barrier layer containing printing fluid channels and vaporization chambers is located between a nozzle orifice plate and a substrate layer. This substrate layer typically contains columnar arrays of heater elements, such as resistors, which are individually addressable and energized to heat printing fluid within the vaporization chambers. Upon heating, a printing fluid droplet is ejected from a nozzle associated with the energized resistor. The inkjet print head nozzles are typically aligned in one or more columnar arrays substantially parallel to the motion of the print media as the media travels through the print zone. Typically, the print media is advanced under the inkjet print head and held stationary while the print head passes along the width of the media, firing its nozzles as determined by a controller to form a desired image on an individual swath, or pass. The print media is usually advanced between passes of the reciprocating inkjet print head in order to avoid uncertainty in the placement of the fired printing fluid droplets.

A printing mechanism may have one or more inkjet print heads, corresponding to one or more colors, or "process colors" as they are referred to in the art. For example, a typical inkjet printing system may have a single print head with only black printing fluid; or the system may have four print heads, one each with black, cyan, magenta, and yellow printing fluids; or the system may have three print heads, one each with cyan, magenta, and yellow printing fluids. Of course, there are many more combinations and quantities of possible print heads in inkjet printing systems, including seven and eight ink/print head systems.

Advanced print head designs now permit an increased number of nozzles to be implemented on a single print head. Thus, whether a single reciprocating print head, multiple reciprocating print heads, or a page-wide print head array are present in a given printing mechanism, the number of printing fluid droplets which can be ejected per second is increased. While this increase in firing rate and density allows faster printing speeds, or throughput, there is also a corresponding increase in the amount of firing data which may be communicated from the printing mechanism controller to the print head or print heads. The increased firing rate and density may increase the possibility of printing fluid shorting, which may be caused by highly conductive printing fluid residue and aerosol in inkjet printing mechanisms. The increased firing rate may also contribute to an increased amount of power consumed by the print head.

Printing fluid residue may build up on the print head nozzle surface and migrate onto the print head connector pads through normal printer operation or removal and installation of the print heads themselves, creating a potential shorting situation for transmission lines. Similarly, air-borne aerosol may deposit onto the print head contacts, creating a potential shorting situation for the transmission lines. Additionally, the printing fluid can also migrate internally within the print head and cause a partial printing fluid short if the print head die is cracked or damaged because of a media crash. The partial printing fluid short can be a result of a physical damage of the print head caused by the print head being dropped. The print head can be damaged by the media impact on the print head. Also, a thermal ink-jetting resistor (TIJ) may wear out and cause a barrier between the print head electronics and the printing fluid to be broken, so the printing fluid penetrates inside the electronics and shorts the electronics.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1:
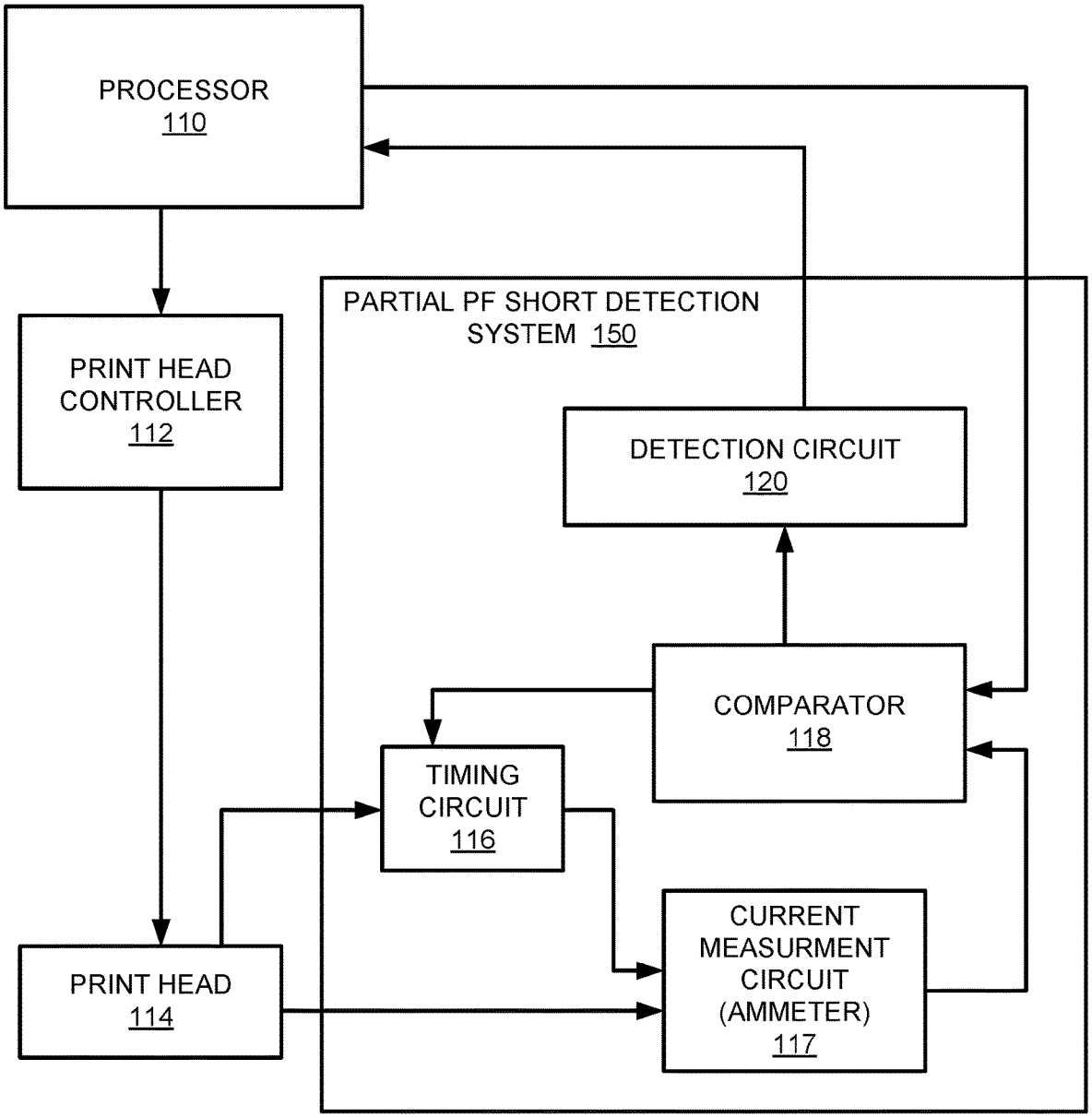
FIG. 1 shows a block diagram of an example of a partial printing fluid short detection system.

For simplicity and illustrative purposes, the present disclosure is described by referring mainly to an example thereof. In the following description, numerous specific details are set forth in order to provide a thorough understanding of the present disclosure. It will be readily apparent however, that the present disclosure may be practiced without limitation to these specific details. In other instances, some methods and structures readily understood by one of ordinary skill in the art have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

According to an example of the present disclosure, a partial printing fluid short detection system can detect a partial printing fluid short in a print head. The partial printing fluid short detection system includes a timing circuit to detect a print gap of the print head, and the partial printing fluid short detection system can detect the partial printing fluid short in response to detection of the print gap. In an example, the timing circuit detects the print gap based on print data. For example, when print data is sent to the print head, the system may cause the timing circuit to reset. When print data is not sent to the print head, the timing circuit counts down until it trips, indicating that a temporal gap in printing performed by the print head has just occurred. When this print gap is detected, a measured current drawn by the print head is compared against a threshold value that represents the normal current drawn by the print head when not printing, e.g., when the print head is idle. When the current measured during the print gap is higher than the threshold, the partial printing fluid short is detected.

Print data may include data associated with or causing printing by a print head. For example, the print data may include a sequence of signals generated by a print head controller in response to receiving print instructions from a processor. In an example, printing fluid drop signals are indicative of firing of print head nozzles, such as in response to a print head receiving print data. The timing circuit may utilize the printing fluid drop signals to detect a print gap. A print gap is a time period when a print head is powered but not printing, such as when the nozzles of the print head do not eject printing fluid drops. A printing fluid (PF) may be a fluid applied on a print medium. For example, the PF may be a mixture of a toner or ink with various types of polymers, such as, for example, styrenated acrylics, polyolefins, polyesters, etc. The PF may be highly conductive. The print gap may be of a predetermined length. In an example, the print gap may be a predetermined number of clock cycles. The print gap may be based on the lag for circuits in the system to measure current draw and compare current draw to a threshold. A partial printing fluid short is an electrical short. The partial printing fluid short may occur in the print head. For example, the partial printing fluid short for a print head may cause a current draw that is lower than a maximum current the print head can draw but is higher than the current that should be drawn by the print head for its current operational state, such as when the print head is not printing. The partial printing fluid short may cause the print head to draw more current than it should normally draw if the partial printing fluid short did not occur. Common causes of a partial printing fluid short in a print head are normal wear, an electrical stress or printing fluid leakages on electrical circuit or transmission lines.

In an example, once the partial printing fluid short is detected in a print head by the partial printing fluid short detection system, the print head is isolated by a power down. A partial printing fluid short can be a safety hazard. For example, in high-power print heads, a partial printing fluid short can present a fire hazard, because the heat generated in the print head can be sufficient to ignite a printed media that is in direct contact with the print head. In low-power print heads, a partial printing fluid short may not be a fire hazard, but can cause a severe print quality degradation due to nozzle malfunctioning. The isolation of the print head may minimize the safety hazard or print quality degradation and may protect the rest of the system from further damage. The isolation of the print head may be implemented by powering down the print head or by termination of the connection between the print head and the corresponding print head controller so the print head does not receive print data. The present disclosure uses a term "coupled" to mean electrical coupling to allow exchange or transmission of electrical signals between circuits.

A partial printing fluid short can be difficult to detect without a complex and comprehensive analysis of operation of the print head and its current draw during its operation. The partial printing fluid short detection system can detect times when no print data is flowing to the print head and check for partial printing fluid shorts at these times. Thus, detection of a partial printing fluid short is simplified and may not use overly complex analysis of actively comparing the actual power consumed by the print head with an estimation of the power to be consumed based on the print density and the energy used per a printing fluid drop.

With reference first to FIG. 1, there is shown a block diagram of an example partial printing fluid short detection system 150 that may perform detection of a partial printing fluid short in a print head. It should be understood that the system 150 depicted in FIG. 1 may include additional components and that some of the components described herein may be removed and/or modified without departing from a scope of the system 100 disclosed herein.

A processor 110 may control operations of a print head controller 112. The processor 110 may be a semiconductor-based microprocessor, a central processing unit (CPU), an application specific integrated circuit (ASIC), a field-programmable gate array (FPGA), and/or other hardware device. The processor 110 sends print commands to the print head controller 112. The print head controller 112 determines print data and sends it to the print head 114.

The system 150 includes timing circuit 116 which may be coupled to the print head 114. The timing circuit 116 may detect a print gap of the print head 114 based on print data from the print head controller 112 that controls printing by the print head 114 or is otherwise associated with printing performed by the print head 114. In an example, drop count signals are derived from print data sent from the print head controller 112 to the print head 114 to cause the print head 114 to print on a print medium. A drop count may be a number of printing fluid drops ejected by a nozzle on a print head, and a drop count signal may be indicative of firing of a print head nozzle to eject a drop of printing fluid from the nozzle. The drop count signal may be asserted, such as to a high logic level, to indicate incrementing of a drop counter in response to ejection of a drop of printing fluid from the nozzle. The timing circuit 116 resets when a drop count signal is detected, such as when the drop count signal is asserted to the high logic level from a low logic level, indicating the nozzle ejected a drop of printing fluid and the print head is printing. If the drop count does not increment, e.g., the drop count signal is at a low logic level, the timing circuit 116 increments until the timeout count is reached. Then, the timing circuit 116 trips and the printing gap is detected. The print head 114 is not ejecting printing fluid during the print gap. When the timing circuit 116 trips, the current measurement circuit 117 receives a signal from the timing circuit 116 to measure a current draw of the print head 114. In an example, the current measurement circuit 117 may be implemented as an ammeter. The timing circuit 116 and its operation are further described with respect to FIG. 2.

The comparator 118 receives a signal indicative of the current draw measurement from the current measurement circuit 117. The comparator 118 also receives a threshold print head current value, which may be representative of a normal current drawn by the print head 114 when not printing. In an example, the threshold print head current value is set to the amount of current that should be drawn by the print head when it is not printing plus a margin. For example, if the print head 114 is not printing, assume the print head 114 should be drawing 100 milliamps if it is operating normally and there is no partial printing fluid short. Also, assume the maximum current the print head 114 may draw is 2 amps. The threshold print head current value is set to 100 milliamps plus a margin, but is less than the maximum current draw of 2 amps. If the margin is 50%, then the threshold print head current value is set to 150 milliamps. Other margins may be used to determine the threshold print head current value. In an example, the margin may be based on a current value that is determined to cause a safety hazard if the threshold print head current value is exceeding during a printing gap. The comparator 118 sends a printing fluid short indication to the detection circuit 120, if the measured current drawn by the print head 114 exceeds the threshold print head current value. If the measured current drawn by the print head 114 is below the threshold print head current value, the timing circuit 116 is reset. The detection circuit 120 associates the partial printing fluid short indicator with the print head 114 and sends a notification to the processor 110. In an example, the notification is an interrupt sent to the processor 110, and the processor 110 may determine whether to power down the print head 114 responsive to the interrupt. The processor 110 sends a command to a corresponding print head controller (112 in this example) to isolate the print head 114 in order to stop its operation. The print head may be isolated by termination of a print data flowing into the print head or the print head may be isolated by powering down the print head 114 by the processor 110. In one example, the detection circuit 120 may be implemented on the processor 110. In this case, the detection circuit 120 may receive a signal from the comparator 118 indicating the measured current value exceeded the threshold print head current value, and the detection circuit 120 determines whether conditions exist to invoke isolation, e.g., powering down, of the print head 114.

Figure 2:
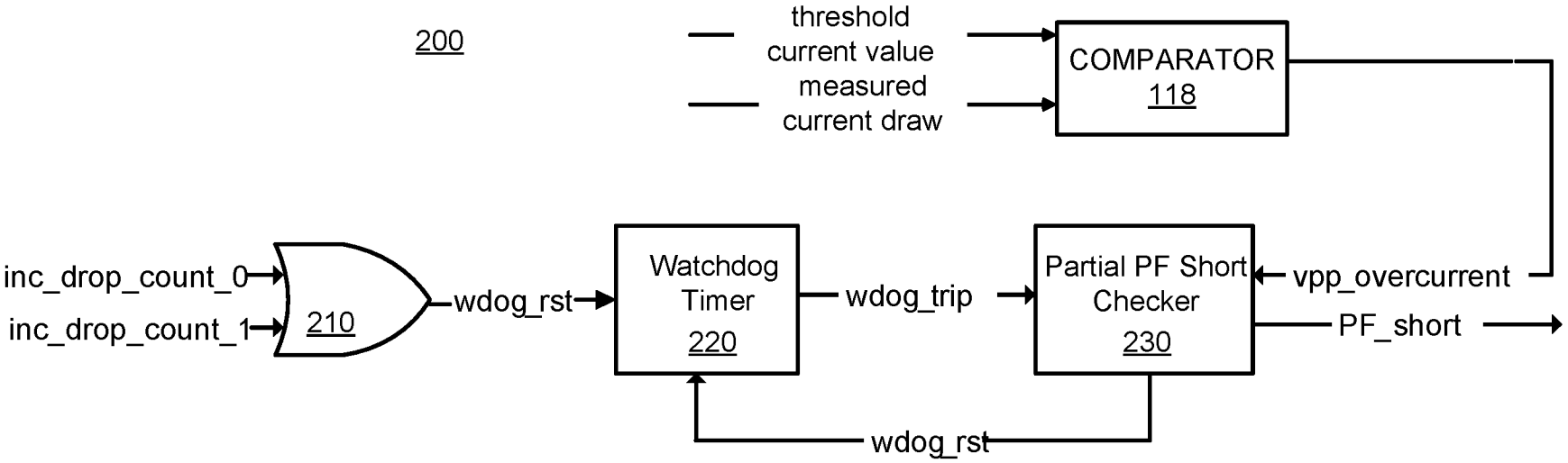
FIG. 2 shows a flow diagram of an example of partial printing fluid short detection for a print head.

With reference to FIG. 2, there is shown a block diagram of another implementation of the partial printing fluid short detection system 150, which is shown as partial printing fluid short detection system 200. A drop counter, which may be implemented in the print head controller 112 shown in FIG. 1 for each serial trench data input line coupled to the print head 114, counts the number of printing fluid drops for each nozzle. In an example, drop counts for nozzles on the print head 114 are stored in drop_count registers. These registers may be read/clear type registers so that when they are read, they are automatically reset to a zero count. By way of example, two lines are shown that are carrying drop count signals, inc_drop_count_0 and inc_drop_count_1, provided as inputs to OR gate 210. The drop count signals indicate increments in drops counts for the nozzles in each trench of the print head 114. So, together the drop count signals inc_drop_count_0 and inc_drop_count_1 indicate if drops are being ejected in any of the nozzles in the print head 114. In other words, the partial printing fluid short detection system 150 determines that no nozzle in the entire print head 114 is ejecting printing fluid, assuming the print head 114 has two trenches of nozzles. Then, the print head 114 is idle and a current drawn by the print head 114 can be measured and compared to a vpp_overcurrent signal discussed below. In one example, the drop counts may be read from the registers discussed above. Printing fluid drop signals may be derived from print data discussed in FIG. 1.

The timing circuit 116 may be implemented by watchdog timer 220 shown in FIG. 2. When either signal, e.g., inc_drop_count_0-1 indicating incrementing of a drop counter is asserted, the OR gate 210 asserts wdog_rst to reset the watchdog timer 220. If neither of the signals inc_drop_count_0-1 are asserted, the watchdog timer 220 increments until a timeout count of the watchdog timer 220 is reached, and the watchdog timer 220 trips. When the watchdog timer 220 trips, the partial printing fluid (PF) short checker 230 reads the vpp_overcurrent signal from the comparator 118. If the vpp_overcurrent is asserted, indicating the measured current draw of the print head 114 exceeds the threshold print head current value, the PF short checker 230 generates a printing fluid short processor interrupt signal. If the vpp_overcurrent is not asserted, the watchdog timer 220 is reset, and the process of waiting for a print gap resumes. Generation of the printing fluid short indication signal may trigger isolation of the print head 114. In an example, the partial PF short checker 230 is part of the detection circuit 120 shown in FIG. 1. According to an example, as discussed with respect to FIG. 1, the detection circuit 120 receives a printing fluid short indication from the comparator 118. In FIG. 2, the PF_short indication is generated in response to the asserted vpp_overcurrent signal sent from the comparator 118 to the partial PF short checker 230. The vpp_overcurrent signal is asserted in response to the measured current draw exceeding the threshold print head current value. The partial PF short checker 230 shown in FIG. 2 may be part of the detection circuit 120 shown in FIG. 1, and the partial PF short checker 230 may send the PF short indication signal to the processor 110 to trigger the isolation of the print head 114.

Figure 3:
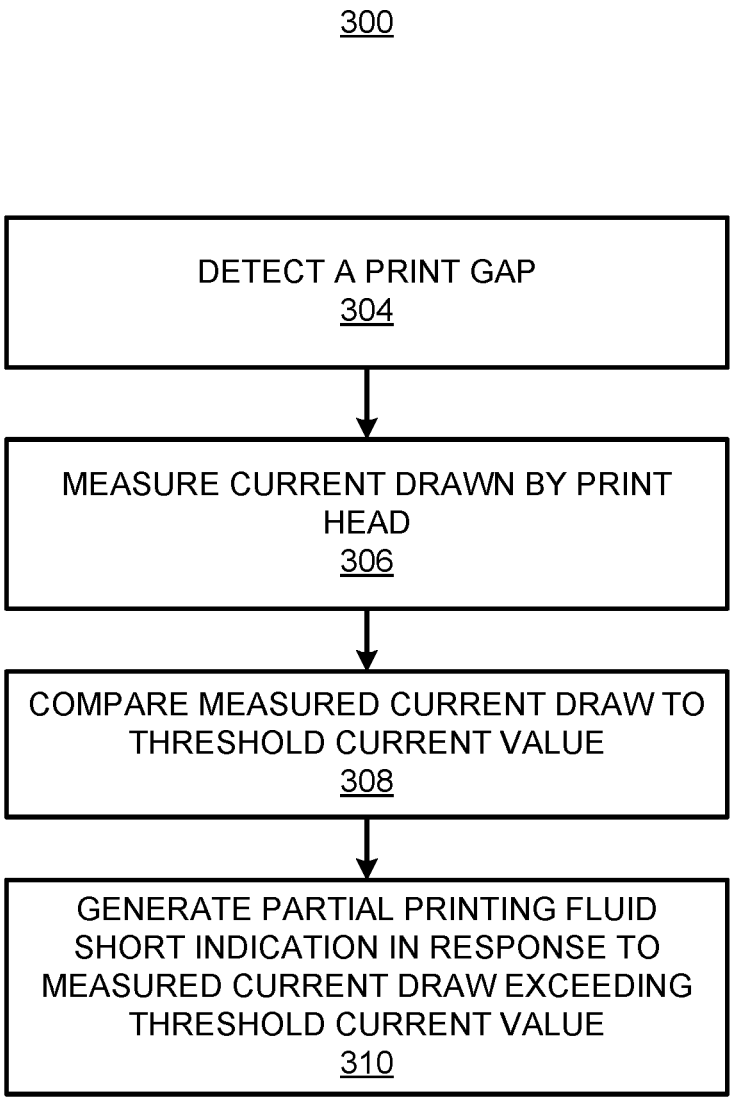
FIG. 3 shows a flow diagram of an example method for partial printing fluid short detection.

Turning to FIG. 3, there is shown a flow diagram of example method 300 for partial PF short detection. The method 300 may be performed by the partial PF short detection system described in FIG. 1 or 2. At block 302, the partial PF short detection system detects a print gap based on print data. At block 304, the partial PF short detection system measures the current drawn by the print head 114. At block 306, the partial PF short detection system compares the measured current draw of the print head 114 to the threshold print head current value. The partial PF short detection system generates the PF short indication at block 308 in response to the measured current draw of the print head 114 exceeding the threshold print head current value. Also, the print head may be isolated if the measured current draw of the print head 114 exceeds the threshold print head current value.

Figure 4:
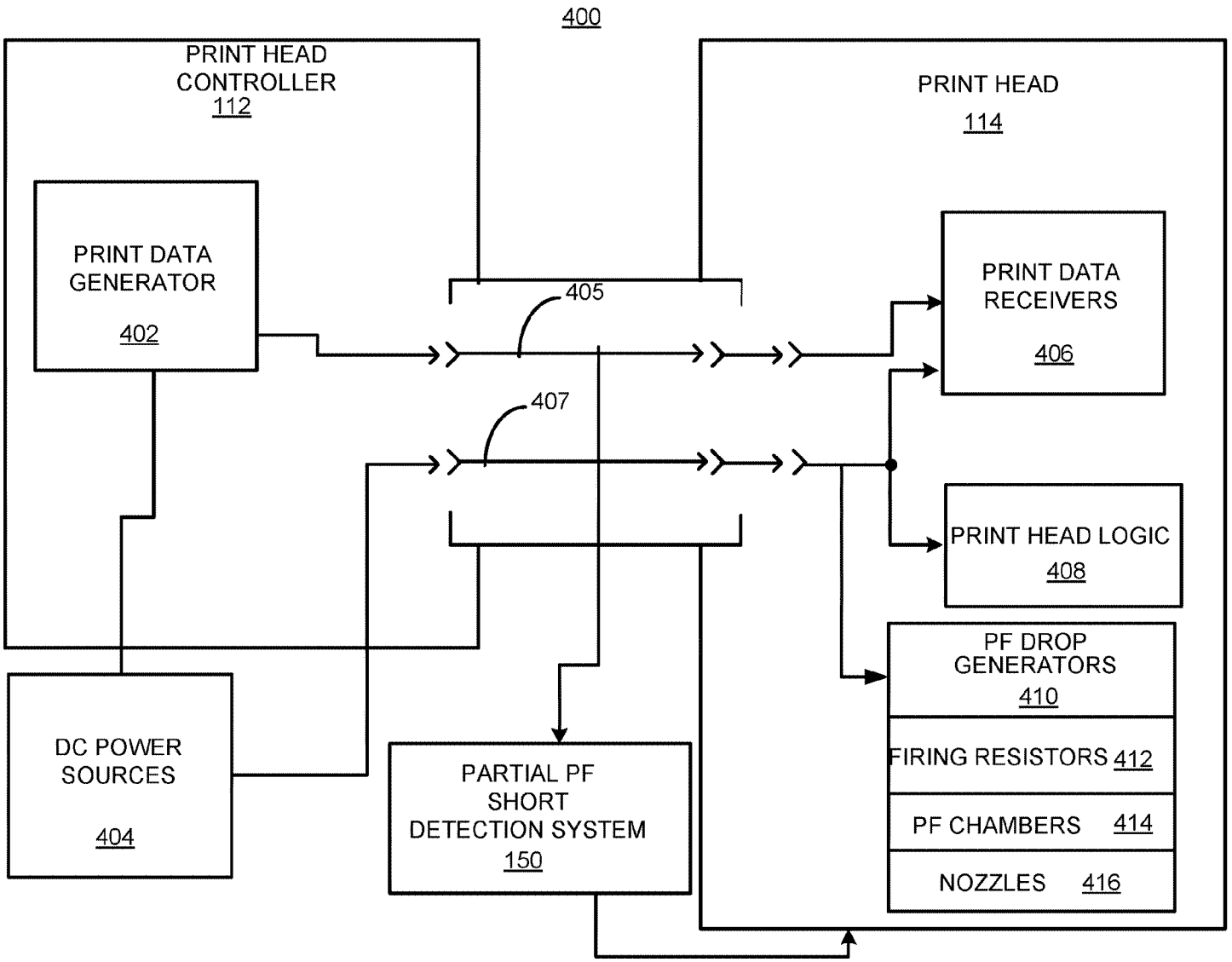
FIG. 4 shows a detailed diagram of an example printer with a partial printing fluid short detection system.

With reference to FIG. 4, there is shown a block diagram of an example printer 400 with partial PF short detection system 150 that may perform detection of a partial PF short in the print head 114. In an example, the print head controller 112 uses differential signaling to communicate data to the print head 114. The print data generator 402 produces print data in a form of signals that are transferred over electrical transmission line 405 to print data receivers 406. DC power sources 408 provide DC voltages to the print head controller 112, and also to the print head 114 over power line 407 in order to power the print data receivers 406, the print head logic module 408, and the print head PF drop generators 410. Different voltage levels may be utilized for each component of the print heads 114. For example, the print data receivers 406 may use 3.3 volts DC, the print head logic module 408 may use 5.0 volts DC, and the PF drop generators 410 may use 30 volts DC.

The DC voltages may be passed through a flexible cable, along with the output print data signals produce by the print data generator 402, to the print head 114. For illustrative purposes, the PF drop generators 410 are shown in FIG. 4 employing thermal inkjet technology, although other types of printing fluid drop technology may be used. The PF drop generators 410 have firing resistors 412, PF chambers 414, and nozzles 416. Upon energizing a selected resistor of the firing resistors 412, a bubble of gas is formed in an associated chamber of the PF chambers 414, and the formed gas ejects a drop of PF from an associated nozzle of the nozzles 416 onto a print media.

The print head controller 112 may send print data in print signals to the print head 114. The partial PF short detection system 150 detects a print gap based on the print data from the print data generator 402. The partial PF short detection system 150 measures a current drawn by the print head 114 during the print gap and compares the current draw to the threshold print head current value. Then, the partial PF short detection system 150 generates a PF short notification, if the measured current draw exceeds the threshold print head current value. The partial PF short detection system 150 may send the partial PF short notification to the processor 110 shown in FIG. 1. The PF short notification to the processor 110 may be a partial PF short processor interrupt signal. The processor 110 handles the partial PF short processor interrupt and isolates the print head 114 in order to avoid its further degradation.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure.

What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A partial printing fluid short detection system to detect a partial printing fluid short in a print head, the system comprising:

a timing circuit coupled to the print head to detect a print gap of the print head, wherein the timing circuit includes:

an OR gate to receive drop count signals of a plurality of nozzles in the print head, wherein the drop count signals indicate counts of print fluid drops being ejected from the plurality of nozzles in the print head, and a timer connected to an output of the OR gate, wherein, in response to none of the plurality of nozzles ejecting any print fluid drops, the OR gate generates a signal to trip the timer to indicate a detection of the print gap of the print head;

a current measurement circuit connected to the timer, wherein, in response to the timer being tripped, the current measurement circuit is to measure a current drawn by the print head during the print gap; and a comparator to compare the measured current drawn by the print head to a threshold value, wherein, in response to the measured current drawn by the print head exceeding the threshold value, the comparator is to send a printing fluid short indication to a detection circuit.

2. The system according to claim 1, wherein the detection circuit is to receive the printing fluid short indication from the comparator and is to provide a printing fluid short notification to a processor, wherein the processor, in response to receiving the printing fluid short notification, is to send a command to a print head controller to power down the print head.

3. The system according to claim 1, wherein the timing circuit is reset responsive to a signal derived from print data, and the signal derived from the print data is indicative of firing of one of the plurality of nozzles in the print head.

4. The system according to claim 1, wherein the current measurement circuit is an ammeter.

5. The system according to claim 1, wherein the detection circuit comprises a printing fluid short checker coupled to the timer and the comparator, and wherein the printing fluid short checker receives an overcurrent signal from the comparator and outputs the printing fluid short indication to a processor.

6. The system according to claim 1, wherein to detect the print gap, the timing circuit is to measure a time gap in receiving the drop count signals of the plurality of nozzles.

7. The system of claim 1, wherein the timer is a watchdog timer.

8. The system of claim 7, wherein the watchdog timer is reset in response to any of the drop count signals being incremented in a clock cycle.

9. The system according to claim 1, wherein the OR gate of the timing circuit detects the print gap when the print head is not printing for a predetermined amount of time.

10. A method for partial printing fluid short detection comprising:

detecting a print gap of a print head, by:

transmitting, by a controller, drop count signals of a plurality of nozzles in the print head to inputs of an OR gate, wherein the drop count signals indicate counts of print fluid drops being ejected from the plurality of nozzles in the print head, and in response to none of the plurality of nozzles ejecting any print fluid drops, transmitting, by the OR gate, a signal to trip a timer to indicate a detection of the print gap of the print head;

in response to the timer being tripped, measuring a current drawn by the print head during the print gap;

comparing the measured current drawn by the print head to a threshold value; and in response to the measured current drawn by the print head exceeding the threshold value, generating a partial printing fluid short indication.

11. The method of claim 10, further comprising isolating the print head in response to the generating of the partial printing fluid short indication.

12. A printer comprising:

a processor, a print head controller to receive print commands from the processor;

a print head comprising a plurality of nozzles, wherein the print head controller is to fire the plurality of nozzles based on the print commands; and a partial printing fluid short detection system comprising:

an OR gate to receive drop count signals of the plurality of nozzles, wherein the drop count signals indicate counts of print fluid drops being ejected from the plurality of nozzles, and a timer connected to an output of the OR gate, wherein, in response to none of the plurality of nozzles ejecting any print fluid drops, the OR gate is to generate a signal to trip the timer to indicate a detection of a print gap of the print head;

a current measurement circuit connected to the timer, wherein, in response to the timer being tripped, the current measurement circuit is to measure a current drawn by the print head during the print gap; and a comparator coupled to the current measurement circuit, wherein, in response to the detection of the print gap by the timer, the comparator is to compare the measured current drawn by the print head to a threshold value, and in response to the measured current drawn by the print head exceeding the threshold value, the comparator is to send a partial printing fluid short indication to a detection circuit, wherein the detection circuit is to receive the partial printing fluid short indication from the comparator and to provide the partial printing fluid short indication to the processor, and wherein the processor, in response to receiving the partial printing fluid short indication, is to send a command to the print head controller to isolate the print head.

* * * * *